United States Patent [19]

Becher

[11] Patent Number: 4,706,805

[45] Date of Patent: Nov. 17, 1987

[54] CARRYING CONTAINER FOR RETURNABLE CANS

[76] Inventor: Patrick J. Becher, 204 Myrtle St., Syracuse, N.Y. 13204

[21] Appl. No.: 866,742

[22] Filed: May 27, 1986

[51] Int. Cl.[4] ..... B65D 71/00

[52] U.S. Cl. ..... 206/144; 206/162; 206/193; 206/199; 206/427; 229/52 A; 229/120.18; 229/120.01; 229/162; 229/183; 229/119

[58] Field of Search ..... 229/17 B, 52 R, 119, 229/27; 206/427, 459, 602, 428, 162, 170, 172, 173, 143, 175, 198, 200, 144, 199; 220/23.83; 248/464, 459

[56] References Cited

U.S. PATENT DOCUMENTS

| | | | |
|---|---|---|---|
| 1,146,103 | 7/1915 | Roy | 248/459 |
| 1,682,838 | 9/1928 | Feigelman | 229/27 |
| 1,828,448 | 8/1929 | Seidel | 229/119 X |
| 3,301,452 | 1/1967 | Jester | 229/52 A X |
| 3,474,949 | 10/1969 | Shine | 206/198 X |
| 3,497,982 | 3/1970 | Schulz | 206/459 X |
| 4,286,709 | 9/1981 | Manizza | 206/144 |
| 4,299,324 | 11/1981 | Dickens | 206/428 X |
| 4,417,657 | 11/1983 | Thibodeau | 206/200 X |

FOREIGN PATENT DOCUMENTS

| | | | |
|---|---|---|---|
| 453296 | 9/1936 | United Kingdom | 206/602 |

*Primary Examiner*—Stephen Marcus
*Assistant Examiner*—Michael J. Shea
*Attorney, Agent, or Firm*—Bruns and Wall

[57] ABSTRACT

A top loading carton made from a unitary sheet of inexpensive disposable material in which returnable beverage containers, such as bottles or cans, are collected and returned to a redemption center. The sheet is folded to form two adjacent bins each of which has a vertically disposed window in the front panel that permits the collected beverage containers to be readily counted and tabulated.

4 Claims, 4 Drawing Figures

CARRYING CONTAINER FOR RETURNABLE CANS

BACKGROUND OF THE INVENTION

This invention relates to an inexpensive carton for collecting and returning deposit containers such as bottles or cans that provides for rapid and accurate redemption of the containers at a store or other suitable collection center.

Many states have recently enacted so-called "bottle laws" designed to curb the littering of their landscapes with unsightly empty bottles and cans. Under the law, a purchaser of bottled or canned beverages pays a deposit upon the container which is later redeemed when the container is returned to the place of sale (store) or a suitable redemption center. All stores selling beverages in containers are required to accept the return of any containers that it sells and refund the deposit.

The stores or redemption centers are further required to separate the containers into various categories such as material, brand names and, in the case of glass containers, color. Many stores insist that the customer separate the beverage containers so that they can be easily counted and sorted with a minumum amount of handling. Because of the general inconvenience involved in the redemption process, many customers elect not to return the deposit containers. Similarly, empty beverage containers are difficult to store and transport. Paper bags, cardboard boxes and other types of cartons have been employed but have proven to be unsatisfactory. For the most part, these cartons are relatively weak and can easily break open when overloaded and/or wet by liquids leaking from the beverage containers. Some of the more easily transported cartons are difficult to load and unload and have a limited carrying capacity. Some prior art cartons for beverage containers are described in greater detail in the following U.S. Pat. Nos.:

1,487,424, 1,948,041, 2,410,615, 3,111,222, 3,119,546, 3,474,949, 4,535,928.

SUMMARY OF THE INVENTION

It is therefore an object of the present invention to improve cartons for collecting and transporting returnable beverage containers.

A further object of the present invention is to provide a relatively inexpensive, easily transportable carton for storing redeemable cans and/or bottles.

A still further object of the present invention is to provide a storing and carrying carton for redeemable beverage containers that is folded from a unitary sheet of inexpensive material.

Another object of the present invention is to provide a top loading redemption carton for storing beverage cans or bottles in verticle bins, each of which has a window so that the number and nature of the containers in each bin are readily perceived.

Yet another object of the present invention is to provide a carton for returning bottles or cans to a redemption center that is equipped with visible scales for rapidly ascertaining the number of beverage containers in the carton and the amount of refund due to the customer.

BRIEF DESCRIPTION OF THE DRAWINGS

For a better understanding of these and other objects of the present invention, reference is had to the following detailed description of the invention to be read in conjunction with the accompanying drawings, wherein.

DESCRIPTION OF THE INVENTION

Figure 3:
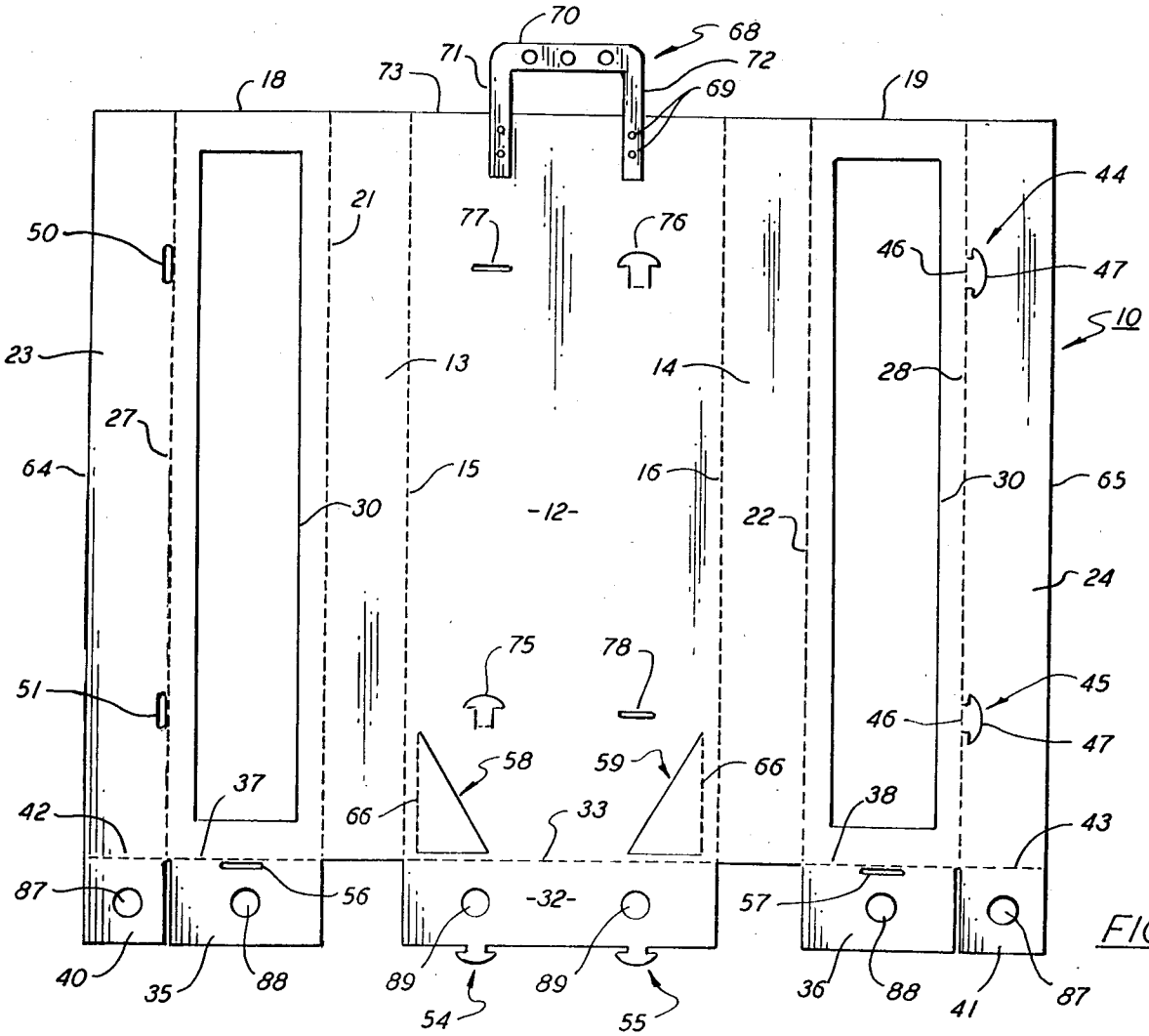
FIG. 3 is a plan view of a unitary sheet that is capable of being folded into a redemption carton shown in FIG. 2.

Referring initially to FIG. 3, there is shown a flat sheet 10 of material that is folded along a series of score lines, indicated by the dotted lines, to create a beverage container carton embodying the present invention. The sheet may be formed of any foldable material such as corrugated paperboard, plastic, fiberboard or the like. The sheet is die cut to the contour shown and includes as rectangular, normally vertically disposed, central back wall 12. The back wall is foldable, joined along its opposed side edges to a pair of outside panels 13 and 14, respectively, along score lines 15 and 16. A pair of front panels 18 and 19 are similarly foldably joined to the opposite side edges of the outside panels along score lines 21 and 22, respectively 16. A final pair of inside panels 23 and 24 are again foldably joined to the opposite side edges of the front panels along vertical score lines 27 and 28.

The width of the inside and outside panels are equal while the width of the two front panels 18 and 19 are equal to one half the width of back wall 12. Each front panel has a vertically disposed window 30 formed thereon. All the vertically disposed panels and the back wall are of equal length so that they can be folded about the score lines to form hollow rectangular bins as will be explained in greater detail below.

A normally horizontal bottom wall 32 depends downwardly from the bottom edge of the back wall 12 along horizontal score line 33. A first pair of bottom reinforcing flaps 35 and 36 are foldably joined to the lower edge of two front panels along horizontal score lines 37 and 38. A second pair of smaller reinforcing flaps 40 and 41 depend downwardly from the lower edges of the two inside panels and are foldably joined thereto along score lines 42 and 43. The bottom wall and the reinforcing flaps are superimposed in assembly.

A pair of locking tabs 44 and 45 are cut into the inside panel 24 adjacent to the score line 28. Each tab has an expanded head 47 and a narrower body section 46. The body section is secured to the sheet 10 at its base and can be popped out from the plane of panel 24. The axial length of the body section is equal to or slightly greater than the thickness of the sheet. The tabs are arranged to be received in vertical slots 50 and 51 formed in the opposing inside panel 23 adjacent score line 27. The head of each tab is made slightly larger than the length of the side with the receiving slot opening so that when the head is forced through the slot it will lock the inside panels together in folded assembly. A similar pair of locking tabs 54 and 55 depend from the lower edge of the bottom wall 32 and are adapted to mate with slotted openings 56 and 57 formed adjacent to score lines 37 and 38 in reinforcing flaps 35 and 36, respectively.

Figure 4:
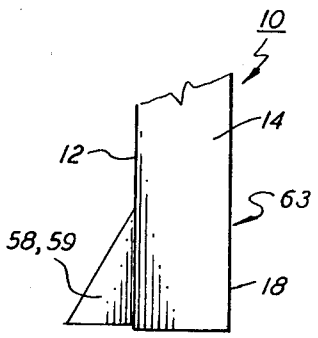
FIG. 4 is a partial end view of the present redemption carton showing the stabilizing wing extended.

A pair of triangular stabilizing wings 58 and 59 are formed in the back wall 12 of the sheet 10. The base and hypotenuse of each wing is die cut through the wall so that the wing is foldably secured to the wall along a score line 66 that represents the vertical leg of the wing. As shown in FIG. 4, the wings can be folded outwardly away from the back wall to form stabilizing elements, the function of which will be explained in greater detail below.

Figure 2:
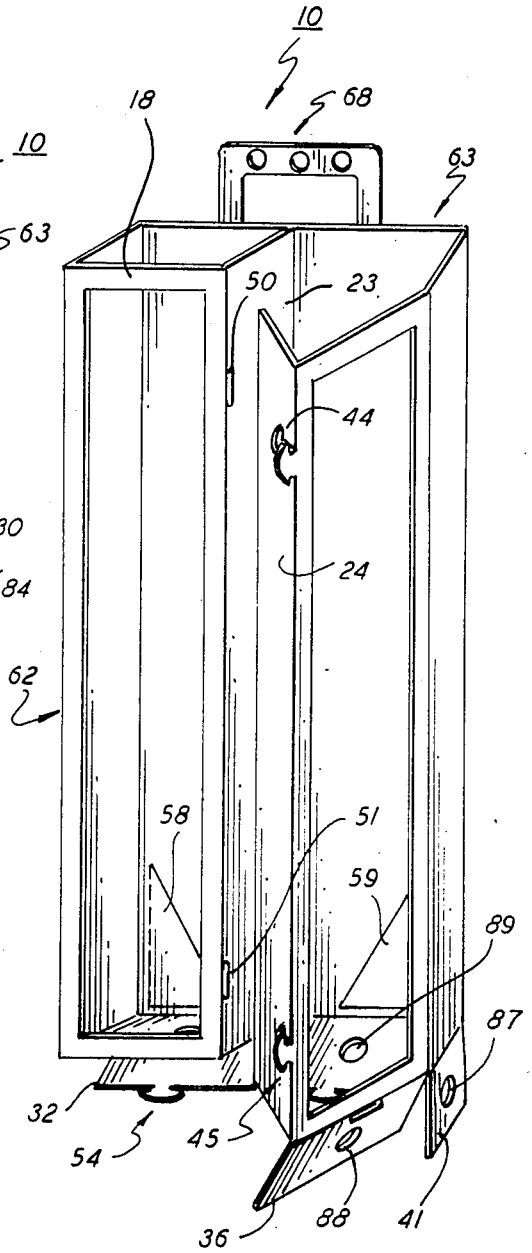
FIG. 2 is also a perspective view of a redemption carton embodying the teaching of the present invention showing one of the storage bins folded into a closed position and the other storage bin in an unfolded condition.

Turning now to FIG. 2, panels 13, 18 and 23 are folded along their mutually shared vertical score lines to form a first rectangular-shaped storage bin generally referenced 62. The panels 14, 19 and 24 are similarly folded along their mutually shared score lines to establish a second rectangular-shaped bin generally referenced 63. In folded assembly, the two inside panels 23 and 24 of the bins are placed in back-to-back alignment with their outer side edges 64 and 65 being seated in abutting contact against the back wall 12. At this time, locking tabs 44 and 45 are passed through the receiving slots 50 and 51, respectively, whereby the panels are locked in place to form two vertically aligned bins. The bins are closed by folding flaps 35, 36 and 40, 41 into a horizontal position along their respective score lines. In assembly, flap 40 is placed over flap 35 at the bottom of bin 62 while flap 41 is similarly positioned over flap 36 at the bottom of bin 63. The bottom wall 32 of the carton is folded under the superimposed flaps and the locking tabs 54 and 55 are passed through receiving slots 56 and 57, respectively, to close the bottom of each bin. As can be seen, the two vertically aligned bins each share a common back wall and a common bottom wall in final assembly. The bins are held in rigid alignment in assembly once the locking tabs are secured within their mating receiving slots thus forming an extremely strong open top structure.

A U-shaped handle 68 is secured to the top edge portion of the rear wall 12 by any suitble means such as rivets 69—69. The crossbar 70 of the handle is supported by legs 71 and 72 well above the top edge 73 of the rear wall so that a firm hand grip can be secured on the crossbar. The handle may be fabricated from the same material as the sheet 10 or any other suitable material having sufficient strength so that the redemption carton can be carried by the handle when the bins are fully loaded with returnable cans or bottles.

Figure 1:
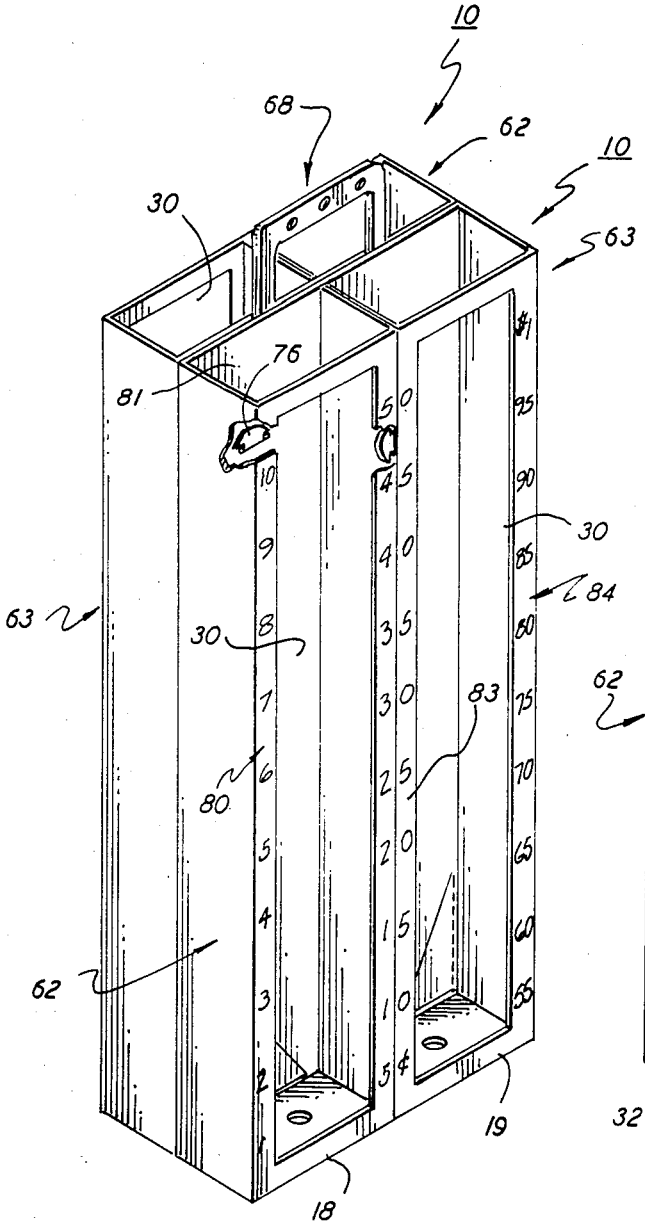
FIG. 1 is a perspective view of a pair of redemption cartons embodying the present invention secured in back-to-back relationship.

Turning now to FIG. 1, two cartons are shown secured in back-to-back alignment to provide a modular package or unit having four separate storage bins. The back wall 12 of each carton has a pair of pop-out locking tabs 75 and 76 similar to those described above and a pair of horizontally aligned slotted receiving openings 77 and 78. When the cartons are placed in back-to-back alignment as shown, the locking tabs 75, 76 of one carton are aligned with the slotted holes 77, 78 of the opposite carton. To join the two cartons, the locking tabs are simply popped out and inserted into the aligned slots in the back wall of the opposite carton thus joining the two cartons into a single unit. This also brings the handles 68, 68 of the two cartons into coextensive alignment to furnish an extremely strong and convenient means for carrying the unit.

When a carton is seated upon a flat support surface, such as a floor or the like, the stabilized wings may be folded out perpendicularly from the back wall 12 to create horizontally extended legs that prevent the carton from being inadvertently tipped over. The wings can be folded back into the back wall when not needed, as for example when a loaded carton is being carried by the handle. The handle can also be used as a hanger that can be passed over a peg or a nail to mount the carton in an elevated position above the floor.

The redeemable beverage containers are loaded into the bins through the top openings with the containers being stacked in a horizontal position one on top of the other. The present carton is adapted to accommodate ten cans of a given size in each bin for an overall carrying capacity of twenty cans. As noted above, the front panel of each bin is furnished with a vertically disposed window that allows the user to visually perceive the number of cans in each bin. As illustrated in FIG. 1, a graduated counting scale is scribed or printed vertically along one side margin of the window 30 formed in front panel 18. The scale is graduated so that the number of cans contained in either bin can be accuately ascertained at a glance.

A pair of vertically disposed redemption value scales 83 and 84 are further printed on the front panels 18 and 19 adjacent the two windows 30, 30. In this particular case, the value scales are arranged to count upwardly in five cent increments to keep a running tabulation of the redemption value of the cans stored in the carton. The values on scale 83 run from five cents to fifty cents and are used to account for the cans in bin 63. The values on scale 84 run upwardly from fifty-five cents to one dollar which is the total redemption value of the cans when both bins are filled.

Although the carton of the present invention has been described with specific reference to storing cans, it can be adapted to similarly accept and store glass or plastic beverage containers of almost any size and shape without departing from the teachings of the present invention. It should be evident to one skilled in the art that the length or width of the various panels and walls making up the bins can be easily altered to accommodate different size beverage containers.

As further illustrated in FIGS. 2 and 3, bleed holes 87–89 can be formed in the bottom wall and the reinforcing flaps used to close the bottom of the bins. The holes permit any liquids that might leak from the beverage containers to be efficiently drained from the carton. This helps to extend the life of paperboard cartons and minimizes the amount of damage by unwanted spillage. The present carton can be made of many inexpensive materials and thus can be economically discarded if it becomes damaged after being used a short period of time.

While this invention has been described with reference to the detailed embodiments as set forth above, it is not intended to be limited to this specific structure and the invention is intended to cover any modifications or changes that may come within the scope of the following claims.

I claim:

1. A top loading carton for beverage containers, the carton being formed from a unitary sheet that includes:

a rectangular, normally vertical, back wall having a given width;

a pair of outside panels of equal width foldably joined respectively to opposite side edges of the back wall;

a pair of front panels foldably joined respectively to opposite side edges of the outside panels, each front panel having a width that is one half that of the back wall, each front panel also having a window that is substantially coextensive with the area of the panel;

a pair of inside panels foldably joined respectively to opposite side edges of the front panels, said inside panels having the same width as said outside panels;

said outside, front and inside panels being folded so that two vertically disposed, open topped bins are formed with the back wall being common to both;

a first locking means for securing the inside panels in back-to-back alignment, said first locking means comprising locking tabs in one of said inside panels which tabs are received in corresponding slots in the other of said inside panels;

a normally horizontal bottom wall means foldably joined to at least a portion of the bottom edge of each bin;

a second locking means comprising interlocking tabs and slots for securing said bottom wall means to each of the bins to close the bottom of each bin; and a hand engageable handle projecting upwardly from said back wall for carrying said carton.

2. The carton of claim 1 that further includes at least one counting scale positioned adjacent a vertical side margin of at least one of the windows for indicating the number of beverage containers stored in either bin.

3. The carton of claim 1 that further includes at least one redemption value scale positioned adjacent a vertical side margin of at least one of the windows for indicating the redemption value of the containers in the bin.

4. The carton of claim 1 wherein said bottom wall means has at least one hole therein for draiing fluids from the bins.

* * * * *